United States Patent [19]

Lingemann

[11] Patent Number: 4,576,841

[45] Date of Patent: Mar. 18, 1986

[54] DESICCANT APPLICATION FOR DOUBLE-GLAZED WINDOWS, ETC. AND A SPACER SECTION FILLED WITH THE DESICCANT APPLICATION

[75] Inventor: Horst Lingemann, Wuppertal, Fed. Rep. of Germany

[73] Assignee: Helmut Lingemann GmbH & Co., Fed. Rep. of Germany

[21] Appl. No.: 439,196

[22] Filed: Nov. 4, 1982

[30] Foreign Application Priority Data

Nov. 4, 1981 [DE] Fed. Rep. of Germany ..... 3143659

[51] Int. Cl.[4] ..... E06B 3/24

[52] U.S. Cl. ..... 428/34; 52/172; 52/788; 52/790; 52/309.16; 428/72; 428/76; 428/73; 428/138; 428/172; 428/192

[58] Field of Search ..... 428/34, 76, 72, 73, 428/426, 138, 192, 172; 52/788, 790, 309, 116, 172

[56] References Cited

U.S. PATENT DOCUMENTS 3,350,553 10/1967 Cline ..... 428/34

3,527,663 9/1970 Rose ..... 428/34

4,399,175 8/1983 Kummermehr ..... 428/76

FOREIGN PATENT DOCUMENTS 1434250 12/1972 Fed. Rep. of Germany ..... 428/34

*Primary Examiner*—Ellis P. Robinson

*Attorney, Agent, or Firm*—Jones & Askew

[57] ABSTRACT

An improved desiccant package for use with double-glazed windows. The desiccant material is disposed in discrete islands of desiccant material, between a pair of elongate sheets of flexible material. The sheets are joined together to contain the desiccant within the joined sheets, and to prevent the desiccant from migrating away from the individual islands. Both sheets are impermeable to the desiccant, but at least one of the sheets is substantially permeable to moisture. The desiccant package is disposed within an elongate tubular spacing member for fitting between the two panes of a double-glazed window. The spacer member has a longitudinal side which faces the air space between the two panes of the double glazing, and this longitudinal side is perforated to allow the atmosphere inside the double glazing to communicate with the desiccant package within the spacer tube.

8 Claims, 3 Drawing Figures cutting the sheet of desiccant, only small quantities of the desiccant are lost when a cut passes through an island of desiccant. In this regard, it is advantageous for the bottom sheet 1 to contain small pockets or indentations 4 which project downward and contain a desiccant 5. As illustrated in FIGS. 1 and 2, desiccant 5 may be granular or powdered, and this invention shows for the first time a method which was not otherwise possible for using a powdered or granular desiccant for the purpose described here.

The cross-sectional shape of the new desiccant application is designed in such a way that it comfortably fits into the hollow space of a spacer section. It is a simple matter to match the cross-sectional shape of the desiccant application to the standard cross-sectional shape of the smallest spacer sectional available on the market, with the intention of inserting two or more desiccant sheets side by side into the cavity of a spacer section with a larger cross section.

The new sheets of desiccant application can be rolled up as such and packaged in an airtight plastic film for marketing so that it can be processed directly for use in double-glazed windows when the spacer frame is assembled. However, the desiccant application is preferably processed directly in shaping the sections of spacer tubes. In this connection, it is known from U.S. Pat. No. 3,380,145 and from German Patent Application No. 2,907,838 that loose desiccant can be poured into a U-shaped preform of the spacer tube, for example, during production of continuous sections. As part of the present invention, the sheets of desiccant application are inserted continuously into the preform while it is still open, then the preform is closed to form the final tube shape and then pieces are cut from the continuous strand. The new desiccant application then assures that almost no desiccant is lost during cutting.

This possibility of cutting across the continuous sectional strand to form pieces did not exist with the given state of the art because of the danger of loss of desiccant which could then escape out of the tube pieces. Instead, the tubular spacer sections filled with desiccant had to be bent and combined directly to form a rectangular closed frame. This invention, however, allows several cut spacer tubes filled with the new sheets of desiccant application to be packaged in airtight films and marketed in this form. In addition, it is also possible to close the ends of the openings in the tubes, e.g., with a butyl compound or some other easily shaped material which can be removed against easily when the closed tubular rod is processed to produce a frame. This variant according to the present invention is especially advantageous when closed tubular sections with welded longitudinal seams are produced in such a way that diffusion holes are merely stamped in the sheet and the perforations are not broken through until the frame is produced. Closing or sealing the ends formed by cutting the pieces in this way assures that the cavity of the tube pieces will be sealed very effectively against the outside atmosphere, thus preventing the desiccant in the new sheet form of desiccant application from taking up moisture from the outside atmosphere, so that it can be sufficient to package and market the tube sections as usual and to bend them to form spacer frames at a later time, preferably according to the method described in European Patent Application No. 0,009,703.

FIG. 3 shows a tube section 6 which is closed by longitudinal welded seam 7. On the longitudinal side which faces the inside of the double glazing in the spacer frame there are indentations 8 which are preferably formed by embossing and are perforated by opening them into the cavity 9 of the tube section when the frame is produced, so that in this way, the desiccant sheet 10 (shown with a dashed line) which is in cavity 9 can act in the desired manner on the atmosphere inside the double glazing. The manner in which the tube 6 is sealed at the end is not shown, so that the simplicity of the illustration would not be impaired.

The use of sheets of desiccant application according to this invention to produce welded spacer tube sections was not self-evident, because temperatures up to about 150° C. can act on the desiccant sheets in welding the tubes. The preferred choice of materials for sheets 1 and 2 and the preferred type of bonding for the sheets contribute to the fact that the new desiccant application can be used for this important and especially economical purpose.

I claim:

1. A double-glazed window assembly comprising:

a pair of mutually spaced-apart window panes mounted in fixed relation;

a hollow moisture permeable spacing tube laterally disposed between said panes;

a desiccant package inserted in the length of said spacing tube;

said desiccant package comprising a first elongate sheet of ductile airtight material;

plural discrete indentations formed in one face of said first elongate sheet at intervals along the length of the first sheet;

a quantity of desiccant disposed in said indentations;

a second elongate sheet secured to said one face of said first sheet to form the desiccant package and enclosing each said indentation and the desiccant therein, so that the desiccant cannot migrate between indentations along the length of the desiccant package; and said second elongate sheet being substantially permeable to moisture but being impermeable to the desiccant, so that the desiccant is retained within the indentations, but moisture entering the spacing tube from between said panes of the double-glazed window can pass through the second sheet for adsorption by the desiccant.

2. The assembly as in claim 1, wherein:

said one face of said first elongate sheet comprises a substantially flat face interrupted by and surrounding said indentations, said second elongate sheet has a substantially flat surface contacting said substantially flat face of the first elongate sheet; and said first and second sheets are joined together in the area of all contacting surfaces of the sheets, so that a lateral cut across the desiccant package can release no more desiccant than enclosed in any indentation in the path of the lateral cut.

3. The assembly according to claim 1, wherein said sheets are secured together in the longitudinal edge areas at the side of each sheet.

4. The assembly according to claim 3, wherein said sheets are secured together by knurling at said longitudinal edge areas.

5. The assembly according to claim 1, wherein said second sheet is a nonwoven sheet which comprises PVC fibers bonded together.

DESICCANT APPLICATION FOR DOUBLE-GLAZED WINDOWS, ETC. AND A SPACER SECTION FILLED WITH THE DESICCANT APPLICATION

SUMMARY

This invention concerns a desiccant application in sheet form for double-glazed windows, etc., so that the desiccant is placed between two sheets which are joined together, and at least one of these sheets is permeable to gas and/or air, but especially to moisture.

This invention concerns a desiccant application in sheet form for double-glazed windows, etc., as well as spacer sections filled with the desiccant application. (The term "application" as used here is borrowed from the pharmaceutical field, where it refers to various aggregate states and forms in which a drug may be administered, e.g., as tablets, liquid, capsules, etc.)

Tubular spacer sections may be made of metal, e.g., steel or a lightweight metal, especially aluminum. The starting material may be a metal sheet which is shaped to form a tubular section by rolling or stamping. The longitudinal edges of the section may either form a very narrow slit or can be welded or soldered together, so that in the latter case, a completely closed hollow section is formed. It is also known that tubular spacer sections can be produced by extrusion of lightweight metal.

As a rule, the spacer sections are in the form of tubes, so that the manufacturer fills the tubes with a desiccant for the double-glazed windows and shapes a frame from the filled tubular sections. The frame is then combined with two panes of glass to form the double glazing.

Filling the spacer section tubes with desiccant is a very time-consuming and tedious job. It is still generally done by hand, resulting in losses due to material which escapes, and the desiccant can also adsorb substantial quantities of moisture from the atmosphere, so that the adsorption capacity of the desiccant with which the sections are filled is already limited.

In addition, it is known from German Patent Application No. 2,907,838 that a spacer frame can be made directly from sheet metal. During the shaping of the section, the granular desiccant is placed in a half-open box section mold, and the mold containing the granules is then folded over to form the final box section mold and closed. The closed box section is next inserted continuously into a bending device where the right-angle U-shaped frame sections are formed. Rectangular frames are then formed from two U-shaped frame sections. In handling the filled frame sections, it is impossible to prevent the desiccant from escaping out of the openings at the ends. In addition, the double-flanged seam is not airtight, so the desiccant adsorbs moisture from the atmosphere.

The purpose of this invention is to create a desiccant application which can be protected from exposure to gas or air and moisture by a simple means and can be handled well.

This goal is achieved according to the features of the main claim. Additional features which are essential to the invention are described in the subclaims. This invention is illustrated in greater detail with reference to the figure.

The application according to this invention is designed as two layers which form a sheet, consisting of bottom sheet 1 and top sheet 2. The sheets 1 and 2 which are layered one on top of the other consist of a flexible material and are joined together in such a way that they will not come apart spontaneously. Preferably, they are joined in the longitudinal edge area 3 at the side. The joining may be assured by knurling, stamping and/or gluing or welding. It may be advisable for all the contact surfaces between the sheets to be joined in the manner described above. Preferably, a combination consisting of stamping and gluing is preferred, where the stamping has grid-like indentations where the two materials are pressed together.

Figure 1:
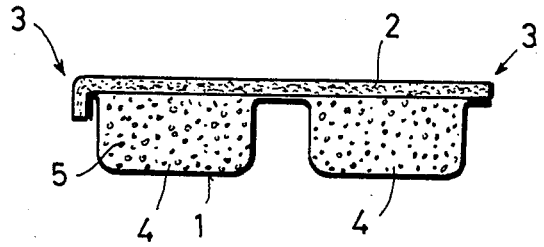
FIG. 1 shows a cross section through the desiccant sheet (greatly magnified).
Figure 2:
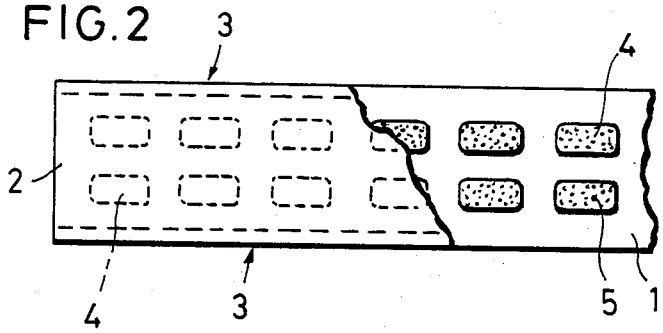
FIG. 2 shows a top view of the desiccant sheet, partially in sectional view.
Figure 3:
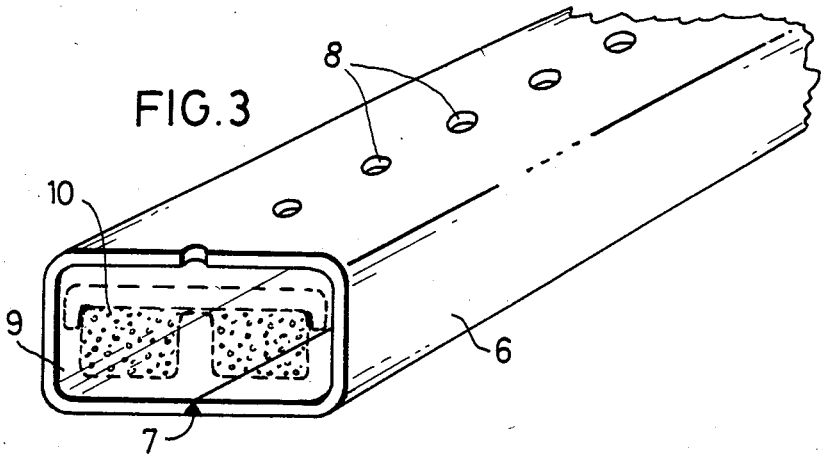
FIG. 3 shows a perspective of the spacer section a tubular piece filled with the desiccant sheet.

It is important for the desiccant to be between sheets 1 and 2, and at least one sheet 1 or 2, preferably top sheet 2, consists of a material which is permeable to gas or air and/or especially to moisture, preferably a porous material, so that atmospheric moisture can reach the desiccant almost unhindered. On the other hand, the material must be so impermeable that the desiccant itself cannot migrate through the material even when the desiccant sheet is subjected to frequent mechanical stresses. In this regard, a porous fiber nonwoven sheet which consists of PVC fibers that are bonded together has proven especially suitable. Another material which is especially suitable is a preferably surface-treated paper, preferably in a thickness of 0.05 to 0.07 mm, preferably 0.06 mm, which can be bonded with polyethylene, for example. When using granular desiccants, it can also be advantageous to use perforated paper, optionally airtight, where the perforations are produced just before use. This possibility facilitates storage of the new desiccant application, because no special measures must be taken to protect the desiccant from moisture. In combination with the permeable sheet, an airtight sheet is preferably used as the second sheet which is preferably coated with polyethylene. In the example shown here, the impermeable sheet is sheet 1, which preferably consists of a ductile metal, preferably aluminum coated with polyethylene, especially aluminum foil in a thickness between 0.05 and 0.1 mm. The advantage of using aluminum sheets is that it is very simple to produce the indentations by known methods, and the bonding with nonwoven sheet 2 leads to a secure joining of sheets 1 and 2. In addition, the aluminum sheet assures sufficient rigidity, while nevertheless it has sufficient moldability so that it can be rolled up to form a tube, for example, or inserted into a sectional rod. Furthermore, it is also possible to bend down the preferably knurled edge 3, as shown on the left side in FIG. 1, for example, or to otherwise shape it in any way which may be necessary in using the new desiccant application.

The arrangement of desiccant between sheets 1 and 2 is preferably such that the desiccant does not escape in substantial quantities when cutting across the sheet. To this extent, the desiccant in granular or powdered form may be fixed by adhesive forces which bond the particles to each other and/or to the surface of at least one sheet (adhesive). According to one particular version of this invention, the desiccant is packed in loose form, in an arrangement of small, defined separate or self-contained heaps spaced at some distance from each other in the form of islands between sheets 1 and 2, so that when 6. The assembly according to claim 1, wherein said second sheet comprises a coated paper, such that the coating on the paper can be bonded with polyethylene.

7. The assembly as in claim 1, wherein said first sheet having the indentations is of a material impermeable to moisture, and said second sheet is permeable to moisture.

8. The assembly as in claim 7, wherein said first sheet comprises a ductile metal having said indentations formed therein.

* * * * *